US009593509B2

(12) United States Patent
Murray

(10) Patent No.: US 9,593,509 B2
(45) Date of Patent: Mar. 14, 2017

(54) DRAWER LOCKING DEVICE

(71) Applicant: Deputy Partners LLC, Woodstock, IL (US)

(72) Inventor: Mark Murray, Woodstock, IL (US)

( * ) Notice: Subject to any disclaimer, the term of this patent is extended or adjusted under 35 U.S.C. 154(b) by 89 days.

(21) Appl. No.: 14/512,371

(22) Filed: Oct. 10, 2014

(65) Prior Publication Data

US 2015/0102715 A1 Apr. 16, 2015

Related U.S. Application Data

(60) Provisional application No. 61/889,516, filed on Oct. 10, 2013.

(51) Int. Cl.

| | |
|---|---|
| ***E05C 1/08*** | (2006.01) |
| ***E05B 65/46*** | (2006.01) |
| ***E05B 65/00*** | (2006.01) |

(52) U.S. Cl.

CPC ..... *E05B 65/46* (2013.01); *E05B 65/0014* (2013.01)

(58) Field of Classification Search

CPC ..... A47B 88/00; A47B 2095/024; A47B 88/0477; A47B 88/047; A47B 88/0481; A47B 2210/0016; A47B 2210/0091; E05B 65/44; E05B 65/46; H05K 7/1411

USPC ..... 292/163, 210, 84, 128; 312/333, 332.1

See application file for complete search history.

(56) References Cited

U.S. PATENT DOCUMENTS

| | | | | |
|---|---|---|---|---|
| 1,326,608 | A | 12/1919 | Nippert | |
| 3,428,349 | A | 2/1969 | Shelton | |
| 3,674,329 | A | 7/1972 | Schill | |
| 3,756,641 | A | 9/1973 | Dugan | |
| 3,850,463 | A * | 11/1974 | Hawkins | E05B 65/0014 292/114 |
| 3,929,362 | A | 12/1975 | Petroff | |
| 3,975,041 | A | 8/1976 | Edison | |
| 4,139,249 | A | 2/1979 | Hillman | |
| 4,148,508 | A | 4/1979 | Adair | |
| 4,304,429 | A | 12/1981 | Gist | |
| 4,630,853 | A | 12/1986 | Bell | |
| 5,203,596 | A | 4/1993 | Stevens | |
| 5,344,226 | A | 9/1994 | Lee | |
| 5,678,797 | A * | 10/1997 | Gogan | B42F 15/0094 211/183 |
| 5,769,517 | A | 6/1998 | Carde | |
| 5,795,044 | A | 8/1998 | Trewhella, Jr. et al. | |
| 6,126,210 | A | 10/2000 | Tom | |
| 6,394,510 | B1 | 5/2002 | Stewart, III | |
| 6,412,891 | B1 | 7/2002 | Liang et al. | |

(Continued)

*Primary Examiner* — Mark Williams

(74) *Attorney, Agent, or Firm* — Richards Patent Law P.C.

(57) ABSTRACT

A drawer locking device for a drawer including at least one side wall, the drawer slidingly closable within a cabinet frame, the drawer locking device including: a mounting portion including three walls defining a U-shaped slot including an inner wall, an outer wall, and a top wall forming a space between the inner wall and outer wall; and a latching portion pivotally coupled to the inner wall, the latching portion including a rear ramp surface, a front surface, and a release lever, wherein, when the drawer safety latch is installed on the drawer side wall such that the drawer side wall is positioned within the space between the inner wall and outer wall, the rear ramp faces the rear of the drawer and the front surface faces the front of the drawer, wherein the latching portion is defeatably biased towards a lock position.

7 Claims, 5 Drawing Sheets

(56) References Cited

U.S. PATENT DOCUMENTS

| | | | |
|---|---|---|---|
| 6,431,616 | B1 | 8/2002 | Julian |
| 6,935,710 | B2 | 8/2005 | Chen et al. |
| 6,942,257 | B2 | 9/2005 | Wong et al. |
| 7,261,329 | B1 | 8/2007 | Julian et al. |
| 7,513,582 | B2 | 4/2009 | Yoon |
| 7,547,050 | B1 | 6/2009 | Miglieri et al. |
| 7,866,192 | B2 | 1/2011 | Gianelo |
| 8,419,080 | B2 | 4/2013 | Levine |
| 8,556,305 | B2 | 10/2013 | Juan et al. |

* cited by examiner

DRAWER LOCKING DEVICE

CROSS-REFERENCE TO RELATED APPLICATIONS

This application claims priority to and the benefit of U.S. Provisional Patent Application No. 61/889,516, filed on Oct. 10, 2013, the disclosure of which is incorporated herein by reference in its entirety.

BACKGROUND OF THE INVENTION

The present subject matter relates generally to a drawer locking device. More specifically, the present invention relates to a locking mechanism which fits on the inside rail of a drawer and locks the drawer with a spring-loaded pin, requiring minimal installation, and leaving the drawer damage-free.

Basic household items such as scissors, kitchen twine, and even pen caps can pose a deadly threat when small children are around. Because of the potential for almost anything to become lethal, concerned parents must child-proof their homes to ensure their children's safety. But this process isn't always easy, especially when it comes to locking drawers.

Drawers act as storage for many of the household items that are dangerous to children. Keeping drawers securely locked is, therefore, crucial to providing a safe environment. Although there are many products on the market to solve this problem, no product is free from significant drawbacks in convenience and effectiveness. For instance, one popular model involves a magnetic lock and key. But the key can be easily misplaced. And even if the key is not lost, the user must still have the key on hand every time she opens the drawer. Furthermore, the magnetic lock installation calls for complicated carpentry, which not only requires extra effort on the part of the user, but also means the drawer will be permanently altered by the lock. Improper installation could result in a defective lock.

Like the magnetic lock and key, other drawer locking solutions involve complicated installation (often requiring tools such as drills, which the user may not even own). These installation procedures mar and damage the cabinetry. Also, most locking mechanisms attach to the inside face of the drawer, which takes up what is often the most valuable of drawer space, or the outside face of the drawer, which can be less than optimal for a clean interior design. Finally, many models are made with materials such as plastic that can warp over time due to extended use. Such erosion further decreases the strength of the lock.

Accordingly, there is a need for a drawer locking device that is easy to install and remove, simple to use, effective, durable, space-saving, and does not substantially damage the drawer, as described herein.

BRIEF SUMMARY OF THE INVENTION

To meet the needs described above and others, the present disclosure provides a drawer locking device that is easy to install, simple to use, effective, durable, space-saving, and minimizes damage to the drawer.

By providing a vice-like locking mechanism that installs on the inside rail of the drawer, the drawer locking device allows the user to install and remove a reliable drawer lock with the use of only two hands. Because the drawer locking device operates using a spring-loaded latch, it is easy to operate.

Unlike most drawer locks that attach at the front of the drawer, the drawer locking device described herein utilizes the space between the side rail of the drawer and the drawer's framing structure. The attachment component of the drawer locking device may be a vice lock, such as a three-sided, U-shaped grip that attaches onto the inside of the side rail of the drawer. The vice is able to straddle the side rail without affecting the operation of the drawer because of the open space between the side of the drawer and the cabinetry that is found in a standard drawer construction. In order to fit this small space, the side of the vice that goes on the outside of the drawer may be unadorned, relatively thin, and unobtrusive.

In one contemplated embodiment, the drawer locking device includes a spring-loaded, ratchet-like mechanism including a latch having a ramped rear-facing surface and a vertical front-facing surface. The latch allows the drawer to freely close as the frame of the drawer contacts the ramped rear-facing surface and compresses the spring to move the latch out of the way. Once closed, the latch prevents the drawer from being opened unless a user manually actuates the spring-loaded latch to unlock the drawer. In other words, once the drawer locking device is installed on the drawer, the user can close the drawer, and as a sloped surface of the latch engages the top edge of the cabinetry that houses the drawer, the latch is pushed down and permits the drawer to freely close. But once the user attempts to pull the drawer back out, the drawer opens only slightly (how much it opens depends on the placement of the drawer locking device) before the latch face of the latch strikes the inside of the drawer frame and prevents the drawer from sliding out any further. As described, if the user wants to open the drawer when the drawer locking device is in use, she need only reach her hand in the drawer and press a lever to actuate the latch. Pressing the lever lowers the latch and allows the drawer to fully open.

The dimensions of the drawer locking device may be configured such that when the drawer locking device is placed as close to the front of the drawer as possible, there will still be enough room for an adult to insert her fingers into the locked and partially open drawer to actuate the lever, but there would not be enough room for a child to extract objects from the drawer.

Because the drawer locking device may use a vice-like mounting portion including thumb tightenable screws, to remove the drawer locking device, the user may simply loosen the knobs on the side of the device and lift the drawer locking device off the side of the drawer without leaving any damage to the drawer or the cabinet.

Embodiments of the drawer locking device may include a three-sided U-shaped bracket that attaches onto the side rail of a drawer including a sideways D-shaped latch housing on the side of the latch bracket that sits inside of the drawer. The latch housing may include two cylindrical protrusions, a left cylindrical protrusion and a right cylindrical protrusion, each including a central threaded passage. Each central threaded passage of the latch housing may include a threaded insert.

The threaded inserts secure the latch to the latch housing and the latch bracket. Each threaded insert is secured to the latch bracket with a retaining ring. The threaded inserts each include a central threaded passage to accept a threaded shaft of a knob. The user may turn the knobs to tighten the threaded shafts against the side rail of a drawer. When tightened, the knobs create a vice-like grip in cooperation with the latch bracket to secure the drawer locking device in place.

In these embodiments, the latch pivots around the left cylindrical protrusion while an elongated, arced opening in the latch permits the latch to actuate freely within a given range without restriction from the right cylindrical protrusion. The latch may held in a locking configuration (i.e., lock position) by a torsion spring. For example, the torsion spring may be connected to the latch on one end and the latch housing on the other.

The latch includes a lever integrally formed in front of and below the face of the latch. By depressing the lever, the user can apply pressure to the torsion spring to cause the latch to actuate. If the user releases the lever, the latch springs back up.

In a second embodiment of the drawer locking device, the drawer locking device may include a latching portion including an upside-down T-shaped channel that holds a spring-loaded pin and lever in the vertical part of the upside-down T-shaped channel. The T-shapped channel may include passages at either end of the horizontal part of the T. These passages penetrate both the T-shaped channel and the side of the device body, allowing for the insertion of a screw in each hole. The screws may have flat, round caps that make them easy to twist by hand. Once the device body is placed on the side of the drawer, the user can turn the screws by hand. This will cause the screws to rotate towards the wall of the drawer and tighten the device body's vice-like grip on the drawer.

The vertical part of the T-shaped channel may contain the locking mechanism of the drawer locking device. Extending from the shaft of the channel and through a hole at the top of the channel is a spring-loaded pin. The spring and pin are visible through a pill-shaped cut-out in the shaft of the T-shaped channel. Protruding at the top of this cut-out and from the side of the pin is a lever. By depressing the lever, the user can apply pressure to the spring underneath the pin and cause the pin to move downward. If the user releases the lever, the pin springs back up.

The top of the pin extends above the top surface of the device body, which sits atop the side of the drawer and connects the sides of the device body. At the tip of the pin, the side of the pin that faces the inside of the drawer is sloped, while the side of the pin that faces outward is generally vertical. Once the drawer locking device is installed on the drawer, as the user closes the drawer, the sloped contour of the pin allows the cabinet to push the pin down as the drawer is closed and allows the drawer to pass under the top edge of the cabinetry that houses the drawer. But once the user attempts to pull the drawer back out, the drawer opens only slightly (how much it opens depends on the placement of the drawer locking device) before the vertical side of the pin strikes the inside of the cabinet frame and prevents the drawer from sliding out any further.

If the user wants to open the drawer when the drawer locking device is in use, she need only reach her hand in the drawer and depress the lever. This will lower the pin and allow the drawer to slide out. The dimensions of the drawer locking device may be such that if the drawer locking device is placed as close to the front of the drawer as possible, there will still be enough room for an adult to insert their fingers and press the lever, but there would not be enough room to extract anything from the drawer. To remove the drawer locking device, the user loosens the screws on the side of the drawer locking device and lifts the drawer locking device off the side of the drawer.

Although described herein as a removable, it is contemplated that the drawer locking device may be built into the side rail of the drawer. When the drawer locking device is integrated into the side rail, the vice-like bracket may be omitted. The knobs may be replaced with bolts that pass through the side rail and are secured by nuts. The nuts may be countersunk to provide a flush surface of the side rail. Alternatively, the device may be screwed into place.

The present disclosure provides a drawer locking device for a drawer including at least one side wall, the drawer slidingly closable within a cabinet frame, the drawer locking device comprising a mounting portion including three walls defining a U-shaped slot including an inner wall, an outer wall, and a top wall forming a space between the inner wall and outer wall. The device also includes a latching portion pivotally coupled to the inner wall, wherein the latching portion including a rear ramp surface, a front surface, and a release lever. When the drawer safety latch is installed on the drawer side wall such that the drawer side wall is positioned within the space between the inner wall and outer wall, the rear ramp faces the rear of the drawer and the front surface faces the front of the drawer, wherein the latching portion is defeatably biased towards a lock position.

During closing of the drawer, the rear ramp engages the cabinet frame actuating the latching portion to defeat the bias towards the lock position to place the latching portion in an open position. Upon fully closing of the drawer, the rear ramp disengages from the cabinet frame and the latching portion returns to the lock position. When the latching portion is in the lock position, during opening of the drawer, the front face of the latching portion encounters the cabinet frame restricting further opening of the drawer. In response to a user engaging the release lever of the latching portion to defeat the bias towards the lock position, the latching portion moves to the open position permitting the drawer to be opened.

The drawer locking device may include an adjustable mounting mechanism that user-selectively engages and releases the drawer side wall within the space between the inner wall and outer wall.

In an example, the adjustable mounting mechanism includes at least one adjustable screw. The at least one adjustable screw may include a knob.

In another example, the rear ramp surface is linear over greater than 90% of its length. The latching portion may be defeatably biased towards the lock position by a spring.

When the drawer safety latch is installed on the drawer side wall such that the front surface faces the front of the drawer, the release lever may be positioned closer to the front of the drawer than the front surface. The release lever and front surface may be integrally formed.

An object of the invention is to provide a solution to locking drawers that has an effective locking mechanism which keeps the drawer securely closed.

Another object of the invention is to provide a solution to locking drawers that does not require complicated installation or removal.

A further object of the invention is to provide a solution to locking drawers that does not mar or damage the drawer.

An advantage of the invention is does not require any tools to install other than the user's two hands.

Another advantage of the invention is that there is a lesser likelihood of faulty installation since installation does not require any tools, measuring or adjustments.

A further advantage of the invention is that it does not take up space at the front of the drawer.

Yet another advantage of the invention is that it takes up minimal space at the side of the drawer.

Another advantage of the invention is that it is made of sturdy materials that will not warp.

A further advantage of the invention is that it allows for easy opening of drawers when the lock is on, requiring only the push of a lever.

Yet another advantage of the invention is that it does not require an external key or other component that could be easily misplaced.

Additional objects, advantages and novel features of the examples will be set forth in part in the description which follows, and in part will become apparent to those skilled in the art upon examination of the following description and the accompanying drawings or may be learned by production or operation of the examples. The objects and advantages of the concepts may be realized and attained by means of the methodologies, instrumentalities and combinations particularly pointed out in the appended claims.

BRIEF DESCRIPTION OF THE DRAWINGS

The drawing figures depict one or more implementations in accord with the present concepts, by way of example only, not by way of limitations. In the figures, like reference numerals refer to the same or similar elements.

DETAILED DESCRIPTION OF THE DISCLOSED EMBODIMENTS

Figure 1:
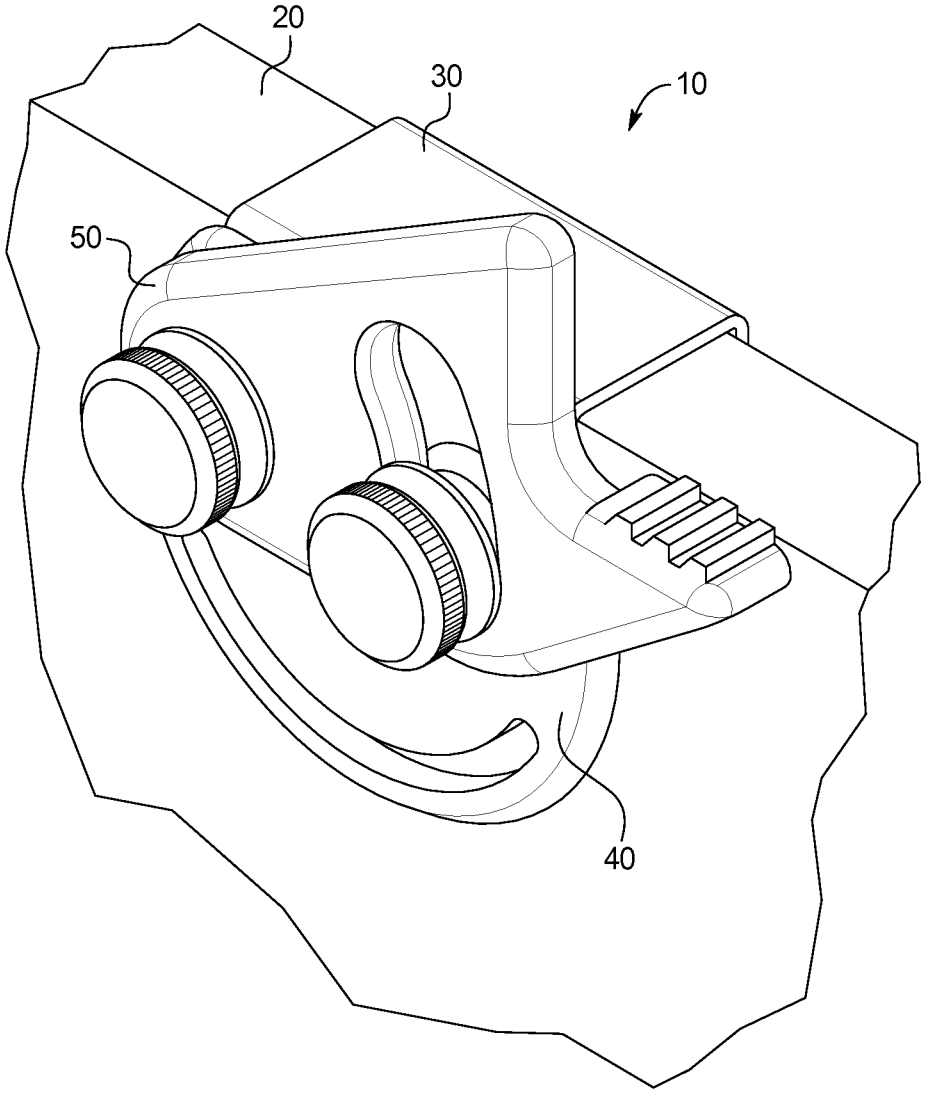
FIG. 1 is a perspective view illustrating a first example of a drawer locking device secured to the side rail of a drawer.
Figure 2:
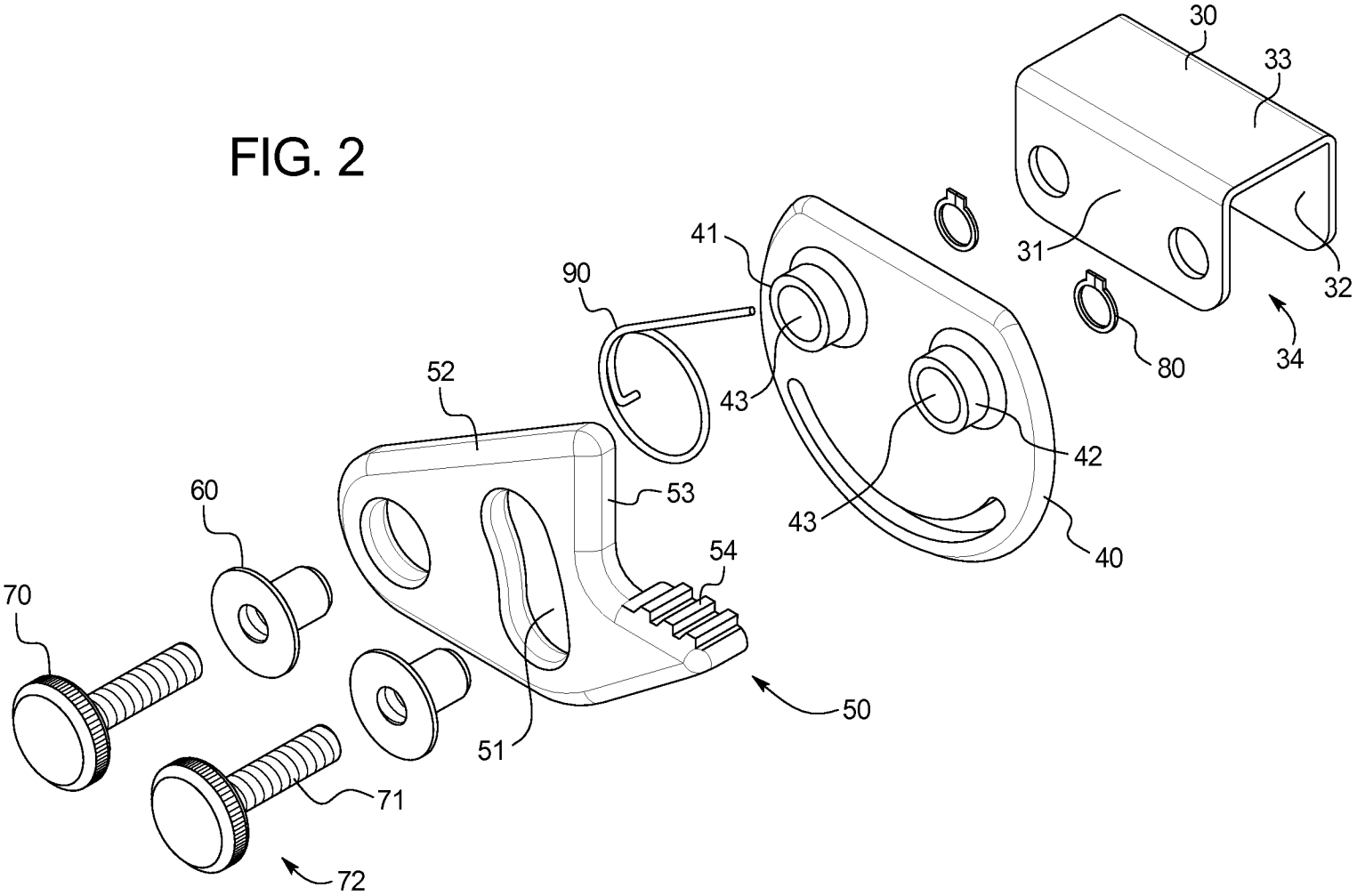
FIG. 2 is an exploded view of the drawer locking device shown in FIG. 1.

FIG. 1 illustrates a first embodiment of the drawer locking device 10 secured to a side rail or side wall 20 of a drawer. FIG. 2 is an exploded view of the drawer locking device 10 illustrating the components of the drawer locking device 10.

As shown in FIG. 2, in an embodiment, the drawer locking device 10 may include a mounting portion 30 including a three-sided U-shaped bracket that mounts onto the side wall 20 of a drawer. The mounting portion 30 includes an inner wall 31, an outer wall 32, and a top wall 33, wherein the three walls form a U-shape creating a space 34 between the inner wall 31 and the outer wall 32.

Figure 3:
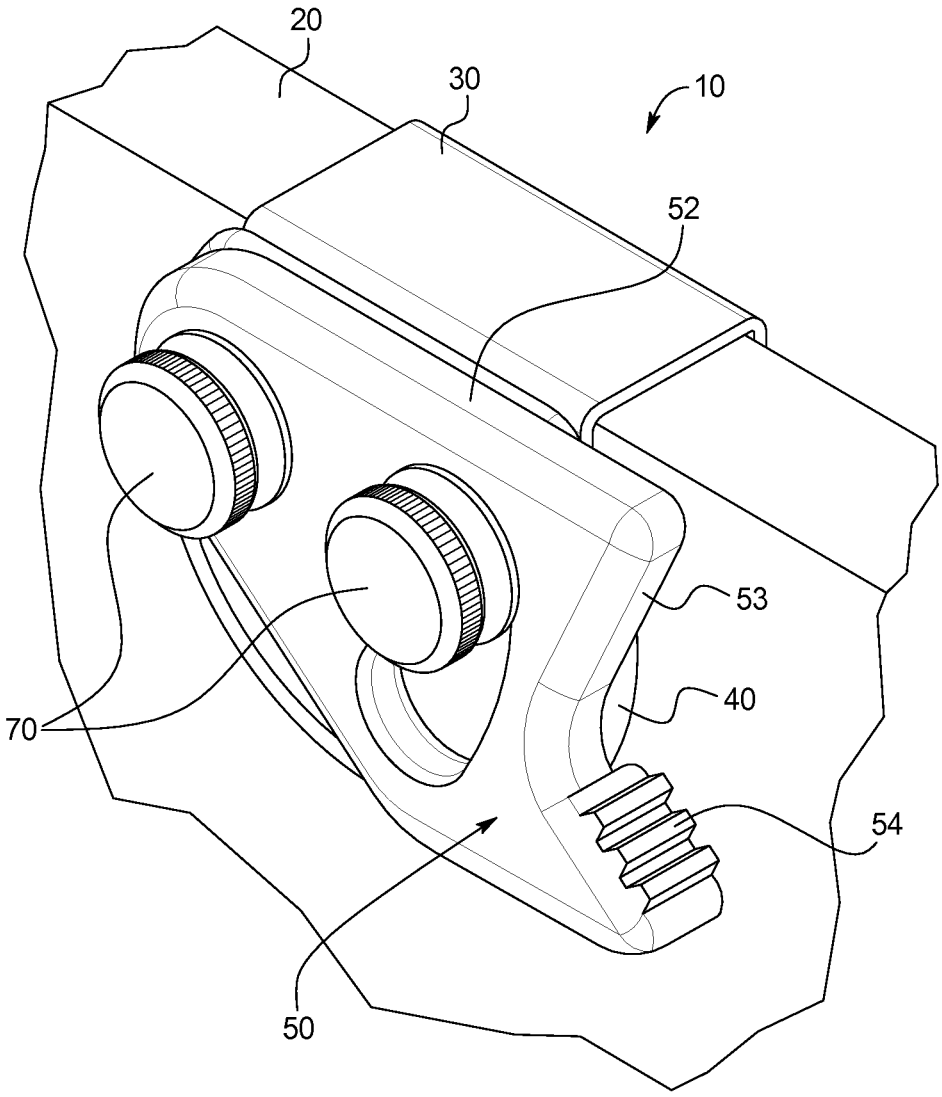
FIG. 3 is a perspective view illustrating the drawer locking device of FIG. 1 when actuated to allow opening of a drawer to which the drawer locking device is installed.

The device 10 also includes a latching portion 50 that provides a ratchet mechanism that allows the drawer to freely close, but does not permit the drawer to be opened unless it is actuated as shown in FIG. 3. The latching portion 50 couples to the inner wall 31, either directly or indirectly, for example with the use of a latch housing 40. The latching portion 50 includes a rear ramp surface 52, a front surface 53, and a release lever 54. In the example shown, the release lever 54 and the front surface 53 are integrally formed, though it is understood that many of the elements of the device 10 may be integrally or non-integrally formed in alternative embodiments.

When the drawer safety latch 10 is installed on the drawer side wall 20 such that the drawer side wall 20 is positioned with in the space 34, the rear ramp 52 faces the rear of the drawer and the front surface 53 faces the front of the drawer and the latching portion 50 is defeatably biased towards the lock position. It is contemplated that the rear ramp surface 52 may be linear over greater than 50%, 75%, or 90% of its length.

During closing of the drawer, the rear ramp 52 engages the cabinet frame actuating the latching portion 50 to defeat the bias towards the lock position to place the latching portion 50 in an open position. Upon fully closing of the drawer, the rear ramp 52 disengages from the cabinet frame and the latching portion 50 returns to the lock position.

When the latching portion 50 is in the lock position, during opening of the drawer, the front surface 53 of the latching portion 50 encounters the cabinet frame restricting further opening of the drawer. In response to a user engaging the release lever 54 of the latching portion 50 to defeat the bias towards the lock position, the latching portion 50 moves to the open position permitting the drawer to be opened.

In an example, when the drawer safety latch 10 is installed on the drawer side wall 20 such that the front surface 53 faces the front of the drawer, the release lever 54 is positioned closer to the front of the drawer than the front surface 53.

The device 10 may provide an adjustable mounting mechanism, wherein the user may selectively engage and release the drawer side wall 20 within the space 34. In the example shown in FIG. 2, the adjustable mounting mechanism is provided by the interaction of the mounting portion 30 and adjustable screws 72 described below. Other adjustable mounting mechanisms may be used, as will be understood by those skilled in the art.

In the example shown in FIG. 2, a latch housing 40 is provided to couple the latching portion 50 to the mounting portion 30. The latch housing 40 may be a D-shaped bracket including two cylindrical protrusions, a left cylindrical protrusion 41 and a right cylindrical protrusion 42, each having a central passage 43. Each central passage 43 of the latch housing 40 may admit a threaded insert 60.

The latching portion 50 may pivot around the left cylindrical protrusion 41 while an elongated, arced opening 51 in the latch 50 permits the latch 50 to actuate freely within a given range without restriction from the right cylindrical protrusion 42. The latch 50 is held in a locking configuration shown in FIG. 1 by a torsion spring 90. The torsion spring 90 may be connected to the latch 50 on one end and the latch housing 40 on the other.

The adjustable screws 72 may secure the latching portion 50 to the mounting portion 30. Each threaded insert 60 may be secured to the latch bracket 30 with a retaining ring 80. The threaded inserts 60 may each include a central threaded passage 61 to accept a threaded shaft 71 of an adjustable screw 72. The user may turn the knobs 70 of the adjustable screws 72 to tighten the threaded shafts 71 against the side rail 20 of the drawer. When tightened, the adjustable screws 72 create a vice-like grip in cooperation with the latch bracket 30 to secure the drawer locking device 10 in place.

Once the drawer locking device 10 is installed on the drawer, the user can close the drawer, and as the rear ramped surface 52 of the latching portion 50 engages the top edge of the cabinetry that houses the drawer, the latching portion 50 is pushed down and permits the drawer to freely close. But once the user attempts to pull the drawer back out, the drawer opens only slightly (how much it opens depends on the placement of the drawer locking device) before the front face 53 of the latching portion 50 strikes the inside of the drawer frame and prevents the drawer from sliding out any further.

As discussed above, the latching portion 50 includes a release lever 54 below the front face 53 of the latching portion 50. As shown in FIG. 3, by depressing the release lever 54, the user can apply pressure to the torsion spring 90 connected between the latch housing 40 and the latching portion 50 to cause the latching portion 50 to actuate. If the user releases the release lever 54, the latching portion 50 springs back up. If the user wants to open the drawer when the drawer locking device 10 is in use, she need only reach her hand in the drawer and press the release lever 54. This will lower the latching portion 50 and allow the drawer to slide out. The dimensions of the drawer locking device 10 may be configured such that if the drawer locking device 10 is placed as close to the front of the drawer as possible, there will still be enough room for an adult to insert her fingers and press the release lever 54, but there would not be enough room to extract anything from the drawer. To remove the drawer locking device 10, the user loosens the knobs 70 on the side of the device and lifts the mounting portion 30 off the side of the drawer.

Figure 4A:
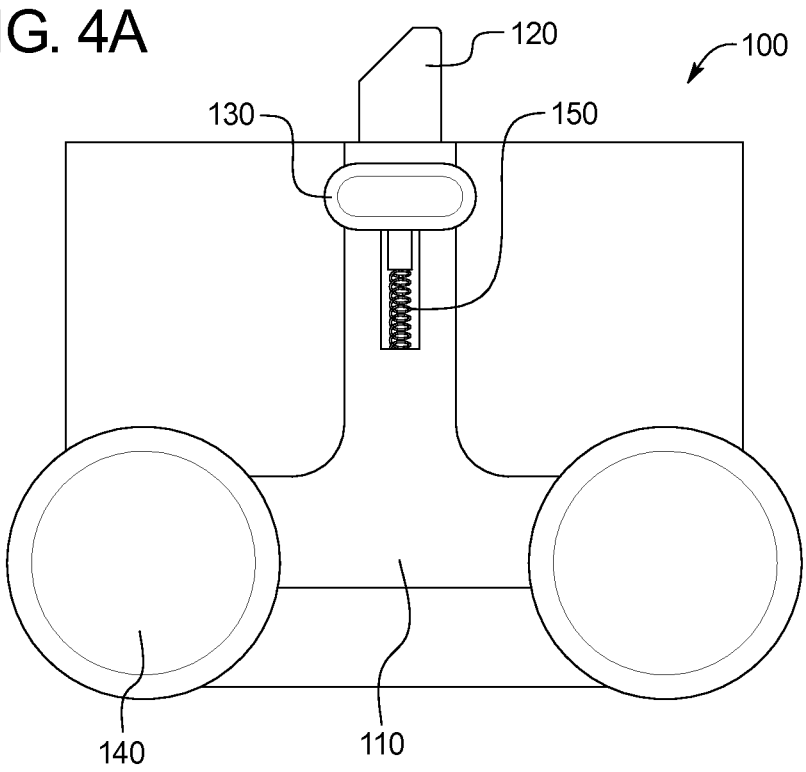
FIG. 4*a* is a front view illustrating a second example of a drawer locking device.
Figure 4B:
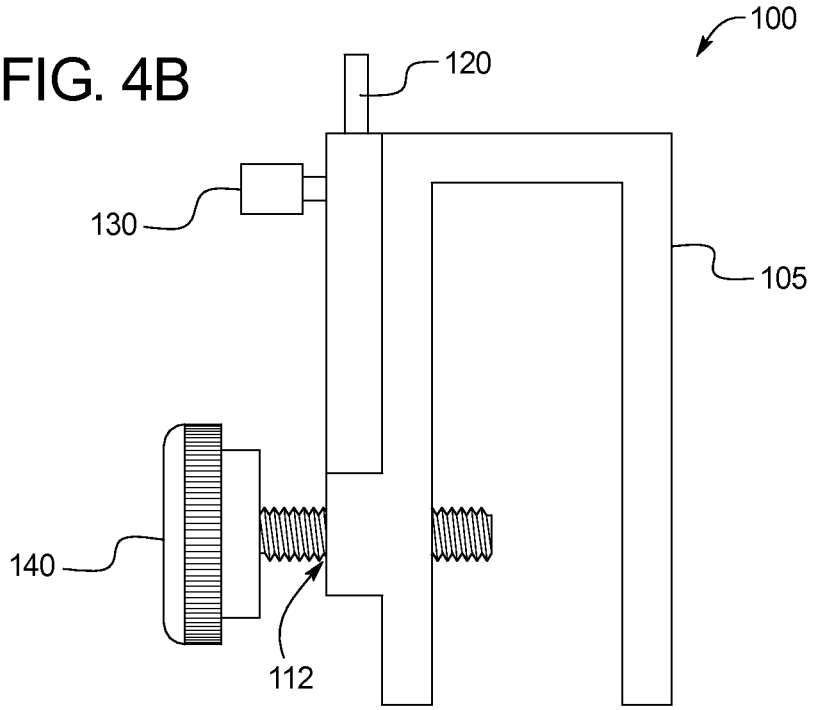
FIG. 4*b* is a side view illustrating the drawer locking device of FIG. 4*a*.

FIGS. 4*a* and 4*b* illustrates a second embodiment of the drawer locking device 100. Again, in this example, the device body 105 of the drawer locking device 100 operates as a vice lock and embodies the mounting portion. For example, the device body 105 may be a three-sided, perpendicular U-shaped grip that mounts onto the inside of the drawer on the side wall 20. The device body 105 may be configured to straddle the side wall 20 because of the open space between the side of the drawer and the cabinetry that houses it. In order to fit this small space, the side of the drawer locking device 100 that goes on the outside of the drawer may be provided without anything on it.

The side of the device body 105 that sits inside the drawer has additional components. In the example shown in FIGS. 4A and 4B, affixed to the device body 105 is an upside-down T-shaped channel 110 which holds a spring-loaded pin 120 and lever 130 in the vertical part of the upside-down T-shaped channel 110 and includes two holes 112 at either end of the horizontal part. These holes 112 penetrate both the T-shaped channel 110 and the side of the device body 105, allowing for the insertion of an adjustable screw 140 in each hole 112. Like the adjustable screws 72 in the previous example, the adjustable screws 140 may include flat, round caps that make them easy to twist by hand. Once the device body 105 is placed on the side of the drawer, the user can turn the adjustable screws 140 by hand. This will cause the adjustable screws 140 to rotate towards the wall of the drawer and tighten the device body's vice-like grip on the drawer.

The vertical part of the T-shaped channel 110 may contain the locking mechanism of the drawer locking device 100. Extending from the shaft of the channel and through a hole at the top of the channel is a spring-loaded pin 120. The spring 150 and pin 120 are visible through a pill-shaped cut-out in the shaft of the T-shaped channel 110. Protruding at the top of this cut-out and from the side of the pin 120 is a lever 130. By depressing the lever 130, the user can apply pressure to the spring 150 underneath the pin 120 and cause the pin 120 to move downward. If the user releases the lever 130, the pin 120 springs back up.

The top of the pin 120 extends above the top surface of the device body 105, which sits atop the side of the drawer and connects the sides of the device body 105. At the tip of the pin 120, the side of the pin that faces the inside of the drawer slopes, while the side of the pin 120 that faces outward in generally vertical. Once the drawer locking device 100 is installed on the drawer, as the user closes the drawer, the contact of the cabinet frame against the sloped contour of the pin 120 pushes the pin 120 down and allows the drawer to pass under the top edge of the cabinet that houses the drawer. But once the user attempts to pull the drawer back out, the drawer opens only slightly (how much it opens depends on the placement of the drawer locking device 100) before the vertical side of the pin 120 strikes the inside of the cabinet and prevents the drawer from sliding out any further.

If the user wants to open the drawer when drawer locking device 100 is in use, she need only reach her hand in the drawer and press the lever 130. This will lower the pin 120 and allow the drawer to slide out. The dimensions of the drawer locking device 100 may be such that if the drawer locking device 100 is placed as close to the front of the drawer as possible, there will still be enough room for an adult to insert their fingers and press the lever, but there would not be enough room to extract anything from the drawer. To remove the drawer locking device 100, the user loosens the adjustable screws 140 on the side of the drawer locking device 100 and lifts the drawer locking device 100 off the side of the drawer.

Figure 5:
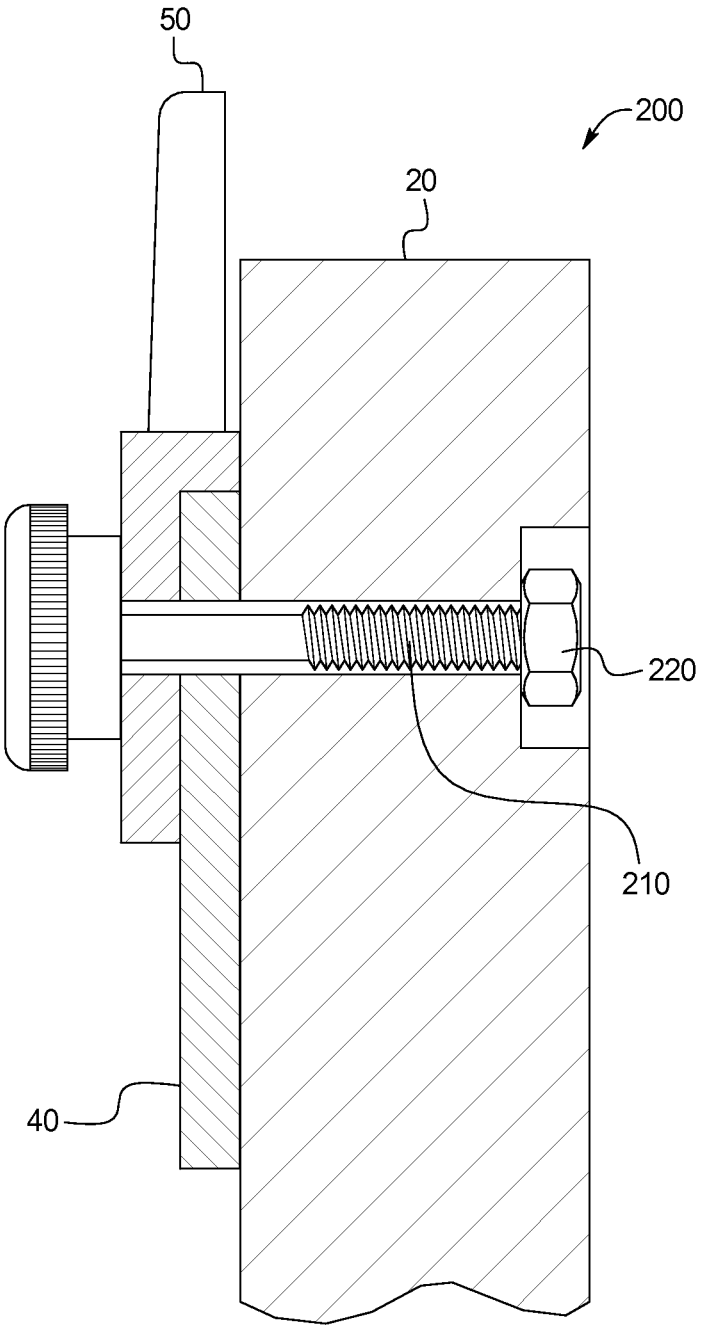
FIG. 5 is a cross-sectional side-view of a third example of a drawer locking device integrated into the side rail of a drawer.

Although described herein as a removable, it is contemplated that the drawer locking device 10 may be built into the drawer. For example, FIG. 5 is a side-view of a third example of a drawer locking device 200 integrated into the side wall 20 (shown in cross-section) of a drawer. Because the drawer locking device 200 is integrated into the side rail 200, there is no U-shaped mounting portion 30 like that shown in the earlier examples. The adjustable screws 72 and 140 from the earlier examples are replaced with bolts 210 that pass through the side rail 20 and are secured by nuts 220. As shown, the nuts 220 may be countersunk. The drawer locking device 200 may include a latch housing 40 and latching portion 50. A torsion spring 90 may be connected between the latch housing 40 and the latching portion 50 to bias the latching portion 50 in a locked configuration, unless actuated.

Although embodiments shown herein illustrate a drawer locking device that may be secured to a right side wall 20 of a drawer, it is appreciated that one skilled in the art would recognize that a drawer locking device that may be secured to the left side wall of a drawer may be made using the teachings herein.

It should be noted that various changes and modifications to the presently preferred embodiments described herein will be apparent to those skilled in the art. Such changes and modifications may be made without departing from the spirit and scope of the present invention and without diminishing its attendant advantages.

I claim:

1. A drawer locking device to be used with a drawer including at least one side wall, the drawer slidingly closable within a cabinet frame, the claimed drawer locking device comprising:

a mounting portion including three walls defining a U-shaped slot including an inner wall, an outer wall, and a top wall forming a space between the inner wall and outer wall;

a latch housing including a first cylindrical protrusion and a second cylindrical protrusion, the cylindrical protrusions defining a first central passage and a second central passage, respectively; and a latching portion pivotally coupled to the inner wall by a first screw engaged through the first cylindrical protrusion and a second screw engaged with the cylindrical protrusion, wherein the latching portion pivots around the first cylindrical portion and the degree to which the latching portion pivots is restricted by the position of the second cylindrical portion within an elongated, arced opening, the latching portion including a rear ramp surface, a front surface, and a release lever, wherein, when the drawer safety latch is installed for use on the drawer side wall such that the drawer side wall is positioned within the space between the drawer locking device's inner wall and outer wall, the rear ramp is positioned closer to the rear of the drawer than the front surface and the front surface faces the front of the drawer, wherein the latching portion is defeatably biased towards a lock position by a spring;

wherein, during closing of the drawer with which the drawer locking device is being used, the rear ramp engages the cabinet frame actuating the latching portion to defeat the bias towards the lock position to place the latching portion in an open position;

upon fully closing of the drawer with which the drawer locking device is being used, the rear ramp disengages from the cabinet frame and the latching portion returns to the lock position;

when the latching portion is in the lock position, during attempted opening of the drawer with which the drawer locking device is being used, the front surface of the latching portion encounters the cabinet frame restricting further opening of the drawer; and in response to a user engaging the release lever of the latching portion to defeat the bias towards the lock position, the latching portion moves to the open position permitting the drawer with which the drawer locking device is being used to be opened.

2. The drawer locking device of claim 1 further including an adjustable mounting mechanism that comprises the first screw and the second screw that user-selectively engages and releases the drawer side wall within the space between the inner wall and outer wall.

3. The drawer locking device of claim 2 wherein at least one of the first screw and the second screw in the adjustable mounting mechanism is an adjustable screw.

4. The drawer locking device of claim 3 wherein the at least one adjustable screw includes a knob.

5. The drawer locking device of claim 1 wherein the rear ramp surface is linear over greater than 90% of its length.

6. The drawer locking device of claim 1 wherein the when the drawer safety latch is installed on the drawer side wall such that the front surface faces the front of the drawer, the release lever is positioned closer to the front of the drawer than the front surface.

7. The drawer locking device of claim 6 wherein the release lever and front surface are integrally formed.

* * * * *